US006560902B1

(12) United States Patent
Eschweiler

(10) Patent No.: US 6,560,902 B1
(45) Date of Patent: May 13, 2003

(54) ORTHOPAEDIC INSOLE

(75) Inventor: Dietmar Eschweiler, Mönchengladbach (DE)

(73) Assignee: Globus Berkemann GmbH & Co. KG, Remscheid (DE)

( * ) Notice: Subject to any disclaimer, the term of this patent is extended or adjusted under 35 U.S.C. 154(b) by 0 days.

(21) Appl. No.: 09/680,223

(22) Filed: Oct. 6, 2000

(30) Foreign Application Priority Data

Oct. 8, 1999 (DE) ..... 199 48 545

(51) Int. Cl.[7] ..... A43B 23/00
(52) U.S. Cl. ..... 36/44; 36/71; 36/154
(58) Field of Search ..... 36/43–44, 93, 36/154, 71, 176, 178, 180, 181

(56) References Cited

U.S. PATENT DOCUMENTS

| | | | | | |
|---|---|---|---|---|---|
| 3,778,251 | A | * | 12/1973 | Trask | 428/215 |
| 4,594,283 | A | * | 6/1986 | Ohigashi | 428/218 |
| 4,715,131 | A | * | 12/1987 | Kremendahl | 36/44 |
| 4,729,179 | A | * | 3/1988 | Quist, Jr. | 36/44 |
| 4,756,096 | A | * | 7/1988 | Meyer | 36/44 |
| 4,823,420 | A | * | 4/1989 | Bartneck | 12/142 N |
| 5,003,708 | A | * | 4/1991 | Daley | 36/44 |
| 5,123,180 | A | * | 6/1992 | Nanning et al. | 36/43 |
| 5,150,490 | A | | 9/1992 | Busch et al. | |
| 5,216,825 | A | * | 6/1993 | Brum | 36/44 |
| 5,365,678 | A | * | 11/1994 | Shibata | 36/29 |
| 5,569,344 | A | * | 10/1996 | Grimnes | 156/90 |
| 5,727,336 | A | * | 3/1998 | Ogden | 36/43 |
| 5,778,562 | A | | 7/1998 | Karl-Heinz | |
| 6,195,917 | B1 | * | 3/2001 | Dieckhaus | 36/44 |

FOREIGN PATENT DOCUMENTS

| | | |
|---|---|---|
| CH | 206957 | 12/1939 |
| DE | 1145962 | 3/1963 |
| DE | 1890305 | 1/1964 |
| DE | 2015489 | 4/1970 |
| DE | 8209746.1 | 9/1982 |
| DE | 8701109.3 | 4/1987 |
| DE | 3701950 C2 | 8/1988 |
| DE | 3802035 A1 | 8/1989 |
| DE | 3804321 A1 | 8/1989 |
| DE | 4437282 C2 | 4/1996 |
| EP | 0443121 A2 | 4/1990 |

* cited by examiner

*Primary Examiner*—M. D. Patterson
*Assistant Examiner*—Jila M Mohandesi
(74) *Attorney, Agent, or Firm*—Birch, Stewart, Kolasch & Birch, LLP

(57) ABSTRACT

Orthopaedic insole with a top cover and a bottom cover, which covers enclose a support core, the top cover and the bottom cover projecting beyond the support core via an edge area and being connected to each other in the edge area. Both the top cover and bottom cover and also the support core are made of a thermoplastic material, the melting points of the three component parts of the insole, namely support core, top cover, and bottom cover, having approximately the same value, and these component parts being permanently connected to one another by pressing and shaping, with melting-on of the contiguous surfaces.

11 Claims, 3 Drawing Sheets

ORTHOPAEDIC INSOLE

The invention relates to an orthopaedic insole with a top cover and a bottom cover, which covers enclose a support core, the top cover and the bottom cover projecting beyond the support core via an edge area and being connected to each other in the edge area.

Such an insole is known from German Patent Specification 4,437,282. According to that document, the known insole is produced by means of covers, designated as cutouts, being pre-heated together with a shaped part which forms the support core, and this is done preferably without adhesive, after which these parts are joined together. The bottom cover is therefore preferably provided with adhesive. No other method of connecting the two covers is mentioned in the document.

The object of the invention is to design the insole in such a way that it can be produced by a relatively simplified method and obtains a special internal stability. According to the invention, this is achieved by the fact that both the top cover and bottom cover and also the support core are made of a thermoplastic material, the melting points of the three component parts of the insole, namely support core, top cover, and bottom cover, having approximately the same value, and these component parts being permanently connected to one another by pressing and shaping, with melting-on of the contiguous surfaces. In the insole according to the invention, there is a fixed connection between the top cover and the support core and between the bottom cover and the support core and also between the edge areas of the top cover and bottom cover projecting beyond the support core, which connection is achieved by a sort of welding-together of the contiguous surfaces, and, in addition, the support core obtains its final therapeutically requisite shape by means of the pressing and shaping, so that the insole is thus formed in a single method step by permanent connection of its three component parts and this shaping. The insole is therefore the result of a single step in which the unworked component parts of the insole, superposed loosely in a press mould, are pressed together, the melting of the contiguous surfaces at the same time bringing about the permanent inner connection of the component parts, and the associated shaping bringing about the final configuration of the insole. A crucial factor in this is that all the component parts of the insole are made of a thermoplastic material and the melting points of the three component parts have approximately the same value, so that the procedure outlined above can bring about the connection of all the component parts in a single step, these component parts then jointly forming the insole, with adaptation to the therapeutic conditions. The top cover is advantageously provided with a skin-compatible covering, for which leather, imitation leather, plastic or the like can be used.

To form the support core, it is possible to use a homogeneous material, e.g. a plastic sheet flattened at its edges. However, it is also possible and particularly advantageous to form the support core using two superposed sheets which each entail a loose running material. Fine plastic granules can be used here which flow upon being heated and form a sheet when cooled. The plastic granules are poured into a mould in which they are made to flow by heating and are limited in terms of their contour by the mould. Thus, sheets of the desired thickness and contour are produced in a known manner, and they are then placed one upon the other, the lower sheet having a shorter longitudinal extent than the upper sheet in order to form the support core. The lower sheet thus essentially forms the support part of the insole which is then given the desired shape for the required therapy by means of shaping and pressing.

To give the insole a high degree of stability, while preserving its bending strength, one of the two covers or both the top cover and bottom cover are made from a two-layer material, in which the inner layer (facing the support core) consists of a woven netting formed by a thermoplastic fibre. The outer layer consists of a thermoplastic film, the melting point of the woven netting and of the plastic film corresponding to that of the three component parts, that is to say the top cover, support core and bottom cover. By using the woven netting, the insole acquires quite considerable strength in its longitudinal extent without thereby losing bending strength, with the result that the insole can, as before, readily adapt to the bending of the shoe as the user is walking. The woven netting ensures that even the support core, which normally forms a cavity directed away from the foot, is given a high degree of elasticity, since the loading of the insole by the foot is in this case taken up not only by the support core alone, but also by the woven netting.

Illustrative embodiments of the invention are shown in the figures, in which.

Figure 1:
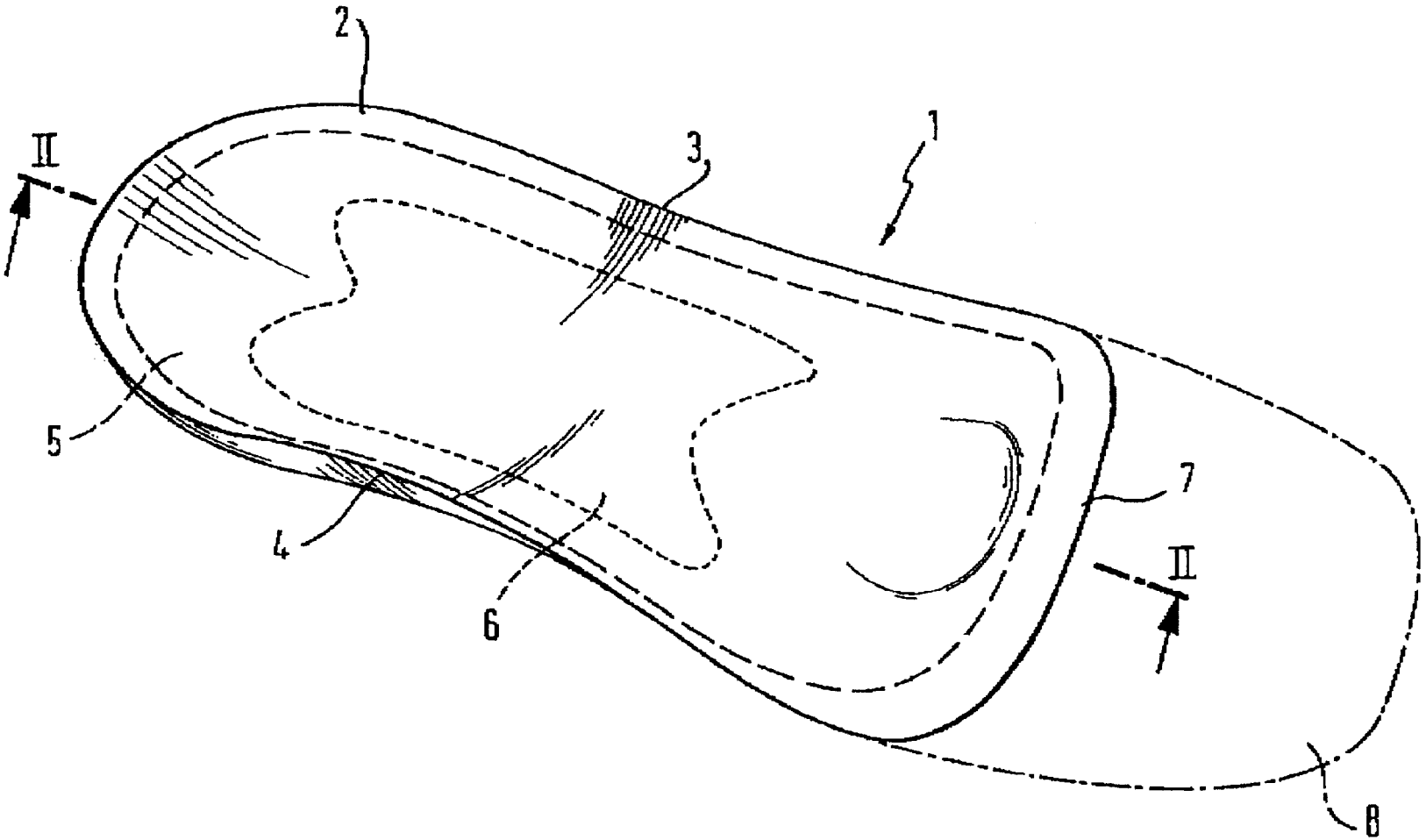
FIG. 1 shows the insole in a perspective view.

FIG. 1 is a perspective view of the insole 1, showing the cover 2 which, in a known manner, is arched upwards slightly in the longitudinal edge areas 3 and 4. The insole 1 contains the support core 5 which is indicated by the broken line and which, in accordance with the above-described design with two sheets, contains the bottom part 6 which has a shorter longitudinal and transverse extent than the whole support core 5, with the result that the supporting force of the bottom part 6 is exerted in particular on the longitudinal arch of the foot.

The insole shown in FIG. 1 normally ends at the edge 7 in the metatarsal region. However, it is also possible to design the insole 1 such that it extends over the whole foot, as is indicated by the front flap 8 with the dot-and-dash line. In this area 8, the insole consists only of the combination of the two abovementioned covers (see FIG. 2), without any supporting force being exerted in this area, and the support core is therefore concentrated only on the rear area of the insole.

Figure 2:
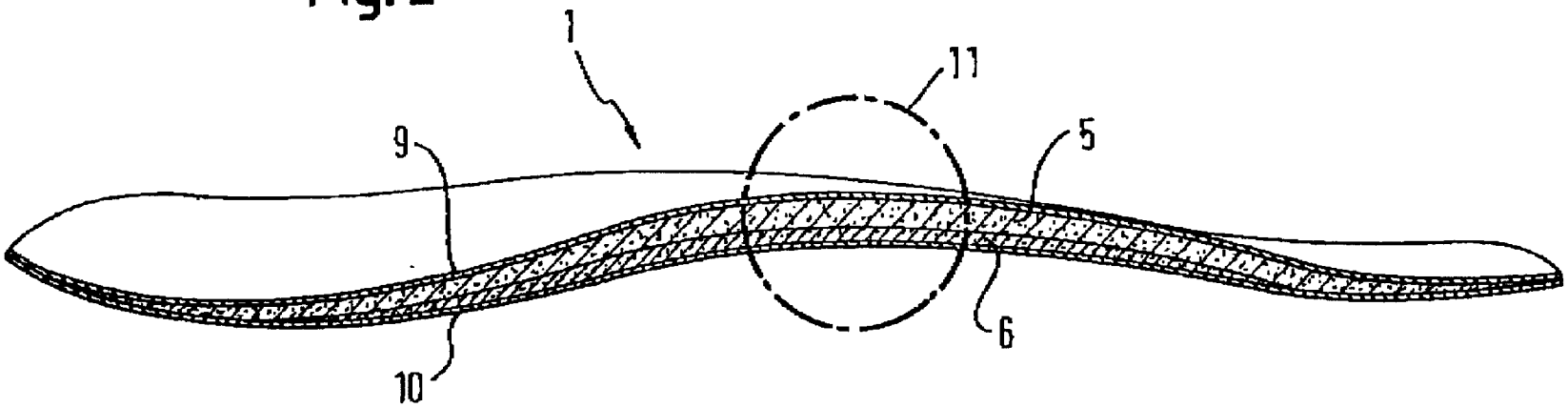
FIG. 2 shows a longitudinal section through the insole.

FIG. 2 shows a longitudinal section through the insole 1 represented in FIG. 1. The insole 1 has the top cover 9 and the bottom cover 10, between which the support core 5 is enclosed, with the bottom part 6 lying under it. These three component parts of the insole, namely top cover 9, bottom cover 10, and support core 5, 6, are connected firmly to one another by melting-on and pressing of the surfaces since they are made of thermoplastic whose melting point has approximately the same value in all component parts of this insole. The blanks from which the top cover 9, bottom cover 10 and support core 5, 6 are formed are for this purpose placed in a heating oven, laid one over the other in a manner which corresponds to their final position, and they are heated in the oven to such an extent that the mutually facing surfaces melt. These blanks are then transferred into a press which has the contours of the finished orthopaedic insole. In the press, the component parts which have thus been laid one over the other are pressed so that the melted surfaces of the component parts are connected intimately with one another and thus together form a continuously firmly connected insole. This pressing can also entail thermoforming, depending on how far the longitudinal edges of the finished insole are raised. The insole thus assumes its configuration represented in FIGS. 1 and 2, in which position, after cooling, it remains stable and loadable.

Figure 3:
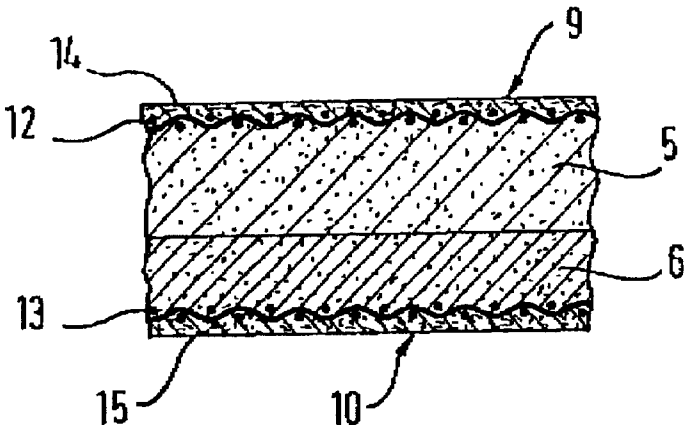
FIG. 3 shows an enlarged detail from the representation in FIG. 2.

The detail shown by the circle 11 in FIG. 2 is represented on a larger scale in FIG. 3. According to this representation, the illustrative embodiment shown is stiffened in a particular way, namely by the fact that the top cover 9 and the bottom cover 10 consist in each case of a two-layer material in which the respective inner layer 12 or 13 consists of a woven netting, which is in this case formed by the weft threads shown as dots and by the warp threads arranged around these. The woven nettings 12, 13 are made of a thermoplastic fibre which has approximately the same melting point as the other component parts of the insole. Towards the outside, the two-layer material is in each case covered by a thermoplastic film 14 or 15 whose melting point likewise corresponds to that of the other component parts of the insole. By means of the woven netting 12, 13, the plastic insole, while retaining its bending strength, is given greater resistance to extension, thereby affording a high degree of elasticity, particularly in the longitudinal edge strips of the insole which are raised to a greater or lesser extent.

Figure 4:
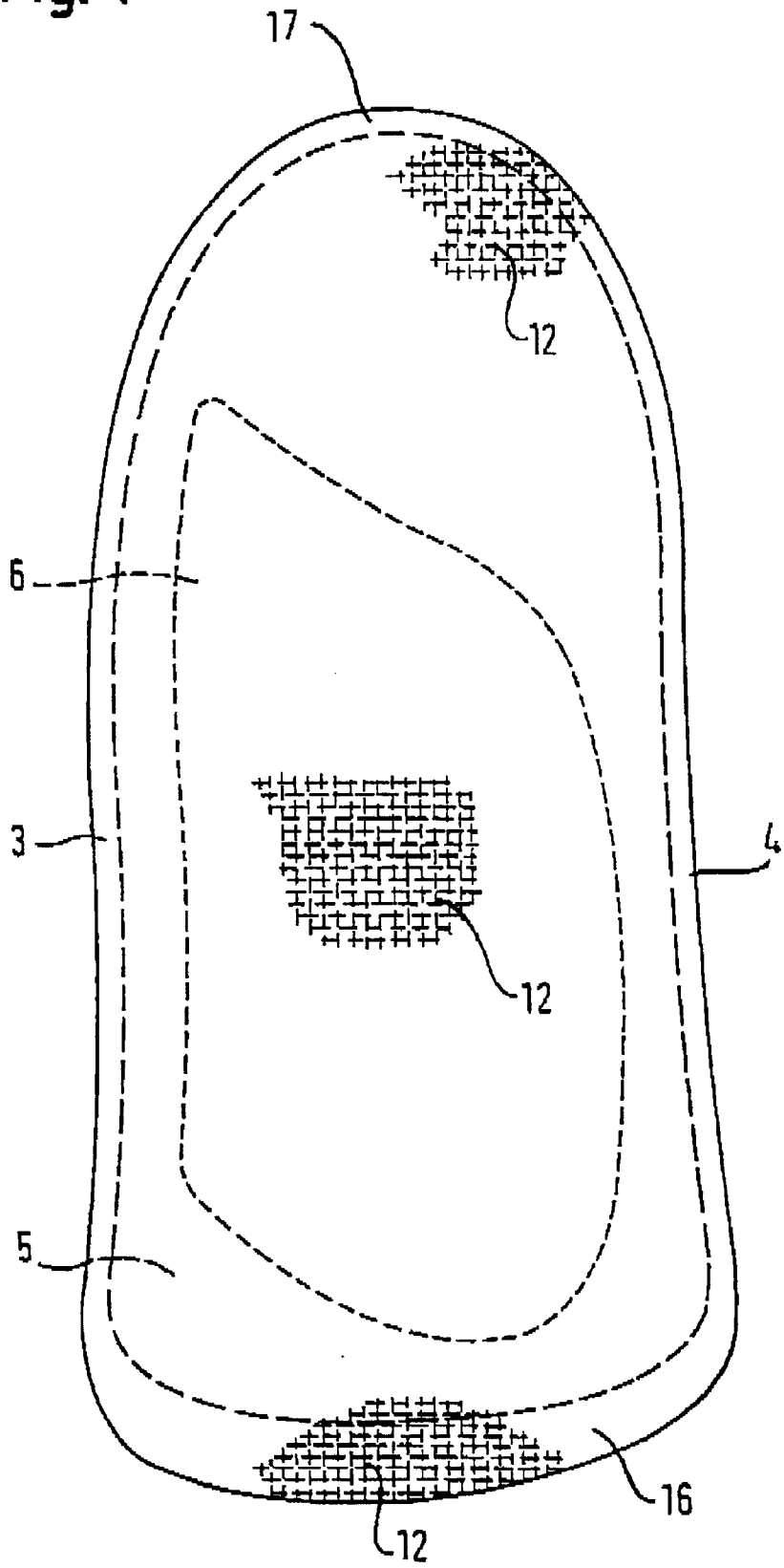
FIG. 4 shows a plan view of the insole, with a woven netting indicated diagrammatically.

FIG. 4 shows a plan view of the insole in which the bottom part 6 has a slightly different edge shape than the bottom part 6 according to FIG. 1. This is a deliberate adaptation to a specific indication for treatment of a foot.

It is evident from FIG. 4 that the edges of the top cover and bottom cover protrude beyond the support core 5, in particular the longitudinal edges 3 and 4 and the transverse edges 16 and 17 which can be seen clearly in FIG. 4.

In the area of these edges 4, 6, 16 and 17, the top cover and the bottom cover are welded firmly to each other. As has been explained above, this weld naturally also extends over the entire surface of the support core 5 with its bottom part 6.

The woven netting 12 indicated in FIG. 3 is also represented in FIG. 4, concentrating, for reasons of simplification, on the middle area of the insole and on the area of the heel and the metatarsal region. The woven netting is indicated by intersecting broken lines. The woven netting extends over the entire surface of the top cover and of the bottom cover (see FIG. 3).

It should also be noted that it may be possible to dispense with a woven netting, so that the latter is then only present either in the top cover or in the bottom cover. However, if the woven netting is used in both covers, a correspondingly increased elasticity of the insole is obtained.

What is claimed is:

1. Orthopaedic insole with a top cover and a bottom cover, which covers enclose a support core, the top cover and the bottom cover projecting beyond the support core via an edge area and being connected to each other in the edge area, characterized in that the top cover is made of a first predetermined thermoplastic material and bottom cover is made of a second predetermined thermoplastic material and the support core is made of a third predetermined thermoplastic material, the melting points of the three component parts of the insole, namely support core, top cover and bottom cover, having approximately the same value relative to each other, and these component parts being permanently connected at the same time to one another by pressing and shaping, with melting-on of the contiguous surfaces, wherein the core is constructed of a different thermoplastic material relative to the top cover and the bottom cover.

2. Insole according to claim 1, characterized in that the top cover is provided with a skin-compatible covering, e.g. leather, imitation leather, plastic.

3. Insole according to claim 1 or 2, characterized in that the support core is formed by two sheets which lie one upon the other and which have each been obtained from a loose running material and are joined together by shaping and pressing, the lower sheet having a longitudinal extent shorter than that of the upper sheet and essentially forming the support part of the insole.

4. Insole according to claim 1, characterized in that at least one of the two covers consists of a two-layer material in which the inner layer consists of a woven netting formed by a thermoplastic fibre, and the outer layer consists of a thermoplastic film, the melting point of the woven netting and of the plastic film corresponding to that of the three component parts.

5. An insole, comprising:

a top cover made of a first predetermined thermoplastic material;

a bottom cover made of a second predetermined thermoplastic material; and a support core made of a third predetermined thermoplastic material and enclosed by said top cover and said bottom cover, said top cover and said bottom cover projecting beyond said support core via an edge area and being connected to each other in said edge area, wherein melting points of said top cover, said bottom cover and said support core having approximately the same value relative to each other, and wherein said top cover, said bottom cover and said support core are permanently connected at the same time to one another by pressing and shaping, with melting-on of contiguous surfaces of said top cover, said bottom cover and said support core and the support core is constructed of a different thermoplastic material relative to the top cover and the bottom cover.

6. The insole according to claim 5, wherein said top cover is provided with a skin-compatible covering.

7. The insole according to claim 6, wherein said skin-compatible covering is leather, imitation leather or plastic.

8. The insole according to claim 5, wherein said support core is formed by two sheets which lie one upon the other and which have each been obtained from a loose running material and are joined together by shaping and pressing, a lower one of said two sheets having a longitudinal extent shorter than that of an upper one of said two sheets and essentially forming said support core of the insole.

9. The insole according to claim 5, wherein at least one of said top cover and said bottom cover comprises a two-layer material in which an inner layer comprises a woven netting formed by a thermoplastic fiber, and an outer layer comprises a thermoplastic film.

10. The insole according to claim 9, wherein the melting point of said woven netting and the melting point of said plastic film correspond to that of said top cover, said bottom cover and said support core.

11. A method of making an insole, comprising the following steps:

providing a top cover made of a first predetermined thermoplastic material, a bottom cover made of a second predetermined thermoplastic material, and a support core made of a third predetermined thermoplastic material, melting points of said top cover, said bottom cover and said support core having approximately the same value relative to each other;

placing said support core between said top cover and said bottom cover, said top cover and said bottom cover projecting beyond said support core via an edge area; and permanently connecting said top cover, said bottom cover and said support core at the same time to one another by pressing and shaping, with melting-on of contiguous surfaces of said top cover, said bottom cover and said support core, thereby enclosing said support core between said top cover and said bottom cover and connecting said top cover and said bottom cover to each other in said edge area, wherein the support core is constructed of a different thermoplastic material relative to the top cover and the bottom cover.

* * * * *